United States Patent [19]

Takigawa et al.

[11] Patent Number: 5,026,496

[45] Date of Patent: Jun. 25, 1991

[54] POLYMER COMPOSITION USEFUL AS VISCOSITY INDEX IMPROVER

[75] Inventors: Shoji Takigawa, Yawata; Kiyoshi Teranishi, Neyagawa; Tomio Nomura, Moriyama; Toshiro Suzuki, Kyoto; Kozo Sakai, Ohmihachiman, all of Japan

[73] Assignee: Sanyo Chemical Industries, Ltd., Kyoto, Japan

[21] Appl. No.: 214,539

[22] Filed: Jul. 1, 1988

[30] Foreign Application Priority Data

Jul. 1, 1987 [JP] Japan ..... 62-164287
Jan. 14, 1988 [JP] Japan ..... 63-6310

[51] Int. Cl.[5] ..... C10M 145/10

[52] U.S. Cl. ..... 252/56 R; 252/52 A; 252/52 R; 252/56 S; 252/51.5 A; 252/50; 585/3; 585/12

[58] Field of Search ..... 252/52 R, 52 A, 56 S, 252/56 R, 51.5 A, 50; 585/3, 12

[56] References Cited

U.S. PATENT DOCUMENTS

| | | | |
|---|---|---|---|
| 4,290,925 | 9/1988 | Pennewiss et al. | 252/56 |
| 4,533,482 | 8/1985 | Bollinger | 585/12 |
| 4,557,847 | 12/1985 | Gutierrez et al. | 252/56 R |
| 4,632,769 | 12/1986 | Gutierrez et al. | 252/56 R |
| 4,677,151 | 6/1987 | Pennewiss et al. | 585/12 |

*Primary Examiner*—Jacqueline V. Howard
*Attorney, Agent, or Firm*—Oblon, Spivak, McClelland, Maier & Neustadt

[57] ABSTRACT

A polymer composition or concentrate comprising:
(A) an olefinic copolymer,
(B) a copolymer of an olefin with a (meth)acrylate,
(C) a poly(meth)acrylate, and
(D) a surfactant, which is poor solvent for both components (A) and (C), which acts as a solubilizer or phase-stabilizer for the components (A) and (C), and which in combination with component (B), which has surface active properties, functions as a phase-stabilizer. The composition has a relatively low viscosity even at high polymer contents and is useful as a lubricating oil additive which improves the viscosity index of a lubricating oil formulation.

20 Claims, No Drawings

POLYMER COMPOSITION USEFUL AS VISCOSITY INDEX IMPROVER

BACKGROUND OF THE INVENTION

1. Field of the Invention

This invention relates to a polymer composition or concentrate. More particularly, it relates to polymer composition or concentrate which is useful as a lubricating oil additive.

2. Description of the Background

As a lubricating additive a concentrated polymer emulsion comprising: (1) a dispersed phase of an olefinic copolymer, (2) a dispersing phase of a polymer predominantly comprising a (meth)acrylate ester monomer, (3) a vehicle which is a good solvent for the esters in said dispersing phase and a substantially poorer solvent for the olefinic copolymer by virtue of the esters dissolved in said vehicle, and (4) a graft or block copolymer formed from olefinic monomers and (meth)acrylate ester monomers has been proposed in U.S. Pat. No. 4,290,925. Such concentrated polymer emulsions do not exhibit sufficiently satisfactory performance properties. The viscosity of these emulsions is not sufficiently reduced, and the emulsions also show, because they are emulsions, thixotropic properties, which are undesirable for the handling of the products.

SUMMARY OF THE INVENTION

Accordingly, one object of the present invention is to provide a polymer composition or concentrate which is useful as a lubricating oil additive.

Another object of the present invention is to provide a polymer composition which exhibits a reduced viscosity even at high concentrations.

Still another object of the present invention is to provide a lubricating oil additive, which is capable of improving the viscosity index (hereinafter referred to as VI) of the fluid to which it is added.

Yet another object of the present invention is to provide a lubricating oil composition having an improved viscosity index.

Briefly, these and other objects of the present invention as hereinafter will become more readily apparent can be attained by a polymer concentrate, which is useful as a lubricating oil additive for improving VI, the concentrate comprising (A) an olefinic copolymer, (B) a copolymer of an olefin with a (meth)acrylate, (C) a poly(meth)acrylate, and (D) a surfactant, which is a poor solvent for both components (A) and (C), which acts as a solubilizer or phase-stabilizer for components (A) and (C), and which in combination with component (B), which has surface active properties, functions as a phase-stabilizer.

DETAILED DESCRIPTION OF THE PREFERRED EMBODIMENTS

Component (A)

Any olefinic copolymers known in the art may be used as component (A) in the present composition. Suitable olefinic copolymers generally include copolymers of two or more olefins such as ethylene, propylene, butylene, iso-butylene, isoprene, butadiene and the like, as well as copolymers of these olefins with other monomers such as styrene, cyclopentadiene, dicyclopentadiene, ethylidene-norbornene and so on. Among the copolymers preferred are ethylene-propylene copolymers (the ratio of ethylene/propylene is preferably 3/1-$\frac{1}{3}$), and styrene-isoprene copolymers.

Olefinic copolymers, which have detergent action sufficient to disperse sludge, varnish and the like in addition to VI improving action, may also be used. Such copolymers include nitrogen atom-containing polymers, for example, those obtained by copolymerizing or grafting, with an acidic component such as maleic acid or anhydride thereof, onto an olefinic copolymer, followed by forming amide or imide linkages by reaction with (poly)amines. Another such copolymer is that obtained by oxidizing an olefinic copolymer, followed by reacting the oxidized polymer with (poly)amines. Still another copolymer is that obtained by oxidizing an olefinic copolymer followed by Mannich condensation with formaldehyde and (poly)amines. Another copolymer is that obtained by copolymerizing olefins with a nitrogen atom-containing monomer, or grafting a nitrogen atom-containing monomer onto an olefinic copolymer such as N-vinylpyrrolidone, N-vinylthiopyrrolidone, a dialkylaminoethyl (meth)acrylate or the like (the content of nitrogen atom-containing monomer preferably being 0.1-10% by weight).

The molecular weight of olefinic copolymers may vary widely, but preferred copolymers are those having a molecular weight (Mw), which can be measured by high temperature GPC (gel permeation chromatography) using a calibration curve of linear polyethylenes, of about 30,000-about 200,000, more preferably about 40,000-about 150,000.

Component (B)

Suitable copolymers of olefins with a (meth)acrylate, as the component (B) in the present composition, include graft-copolymers obtained by grafting a (meth)acrylate under radical polymerization conditions onto an olefinic copolymer, random copolymers obtained by random-copolymerizing olefins with a (meth)acrylate, and block-copolymers obtained by anionic polymerization. Graft-polymerization of a (meth)acrylate onto an olefinic copolymer can be carried out easily by polymerizing a (meth)acrylate in an olefinic copolymer in the presence of a radical catalyst, such as an azo compound, peroxide and the like. (Such a graft-polymerization technique is described, for instance, in Japan 6600/1987 and German Auslegschrift 1235491.) Graft-polymerization, which provides at one time the three components (A), (B) and (C), is preferred from the viewpoint of industrial production. Among suitable graft polymerization catalysts are peroxides, for example, di-t-butylperoxides, dicumylperoxides, dilauroylperoxides, dibenzoylperoxides, methylethylketone peroxides, cumenehydroperoxides, and catalyst which are capable of forming two or more free radicals per mole after decomposition of the catalyst such as 2,5-dimethyl-2,5bis(2-ethylhexanoylperoxy)hexane, 2,5-dimethyl-2,5bis(methylbenzoyl peroxy)hexane, di-t-butylperoxyhexahydroterephthalate, 1,1-di-t-butylperoxycyclohexane, 4,4-di-t-butylperoxyvaleric acid n-butyl ester, and the like.

Olefins and olefinic copolymers suitable for producing component (B) include the same ones mentioned above as embodiments of component (A).

Suitable (meth)acrylates used in producing the component (B) include monomers normally employed for the production of VI improvers of the (meth)acrylate (co)polymers type. Examples of such monomers include:

(a) (meth)acrylates of $C_{8-30}$ straight-chain or branched chain alcohols such as C12–18 alkyl (meth)acrylates;

(b) (meth)acrylates of $C_{1-4}$ straight-chain or branched chain alcohols such as methyl (meth)acrylates; and (c) (meth)acrylates other than above : straight-chain or branched-chain alkyl ($C_{5-7}$) (meth)acrylates and cycloalkyl (meth)acrylates such as hexyl (meth)acrylates and cyclohexyl (meth)acrylates.

The methacrylates (a), (b) and (c) may be used alone or in combinations of two or more methacrylates as component (B).

In producing component (B), in addition to (meth)acrylates, other monomers (d) may be used, for example, aromatic vinyl compounds such as styrene and vinyltoluene; esters of unsaturated dicarboxylic acids such as maleates and fumarates of $C_{1-30}$ straight-chain or branched chain alcohols; nitrogen atom-containing unsaturated compounds such as dialkylaminoethyl (meth-)acrylates, morpholinoalkyl (meth)acrylates, N-vinylpyrrolidone, N-vinylthiopyrrolidone, (meth)acrylonitriles, (meth)acrylamides, N-vinylpyrrolidinone, N-vinylimidazole, and the like. Mixtures of two or more such monomers may be used.

The amounts of these monomers in the present composition can vary widely such as

| | |
|---|---|
| (a): | 50–100%, preferably 60–99%, |
| (b): | 0–50%, preferably 1–30%, |
| and [(c) + (d)]]: | 0–50%, preferably 1–30%, |

based on the total weight of the monomers [(a)+(b)+(c)+(d)].

Preferred are monomers containing (b) $C_{1-4}$ alkyl (meth)acrylate in an amount of at least 7% and comprising (a) $C_{8-30}$ alkyl (meth)acrylate, in which the content of $C_{16-30}$ alkyl (methy)acrylate is at least 15% or less, based on the total weight of the monomers [(a)+(b)+(c)+(d)]. Polymer compositions obtainable from such monomers are excellently uniform transparent liquids of relatively low viscosity.

The content of olefins (or olefin copolymers) in component (B) is generally 10–90%, preferably 20–80% by weight.

The molecular weight of component (B) may be, for instance, about 31,000–about 500,000, preferably about 41,000–about 300,000.

Component (C)

Poly(meth)acrylates, used as the component (C) in the invention, include (co)polymers obtainable from (meth)acrylates or combinations thereof with other monomers. Suitable examples of such monomers are above-mentioned monomers (a), (b), (c) and (d). The amounts of these monomers (a), (b), (c) and (d) may be varied within the same range as described above. Examples of suitable poly(meth)acrylates are those described in JPN 17321/1960(US 3,142,664), JPN 2031/1961, JPN 1202/1973, JPN 1084/1973, JPN 33045/1972 and JPN 11638/1984. The molecular weight (Mw) of component (C), which can be measured by high temperature GPC using polystyrene calibration curves, is usually about 20,000–about 500,000 or higher, preferably about 40,000–about 300,000.

Component (D)

Surfactants, which are poor solvents for both components (A) and (C) which act as a solubilizer or phase-stabilizer for components (A) and (C) in combination with surface activity component (B), which exhibits surface activity, as a phase-stabilizer, used as component (D) in the invention, include oxyalkylated active hydrogen atom-containing compounds and mixtures of two or more of such compounds. Suitable surfactants include, for example, alkylene oxide adducts of compounds containing one or more active hydrogen atom-containing groups such as hydroxyl, amino and amide groups.

Illustrative examples of active hydrogen atom-containing compounds include:

1) monofunctional hydroxyl-containing compounds including saturated or unsaturated, straight-chain or branched chain monohydric alcohols generally containing 1–30 carbon atoms. Such alcohols are, for example, aliphatic alcohols including methanol, ethanol, n- and i-propanols, butanols, hexanols, octanols, decanols, stearyl alcohol, myristyl alcohol and oleyl alcohol; cycloaliphatic alcohols including cyclohexanol and dimethylcyclohexyanol; phenols including phenol, $C_{1-18}$ alkyl or alkenyl-substituted phenols such as octyl phenol, nonyl phenol and dodecenyl phenol;

2) polyfunctional hydroxyl-containing compounds including polyhydric alcohols such as ethylene glycol, propylene glycol, glycerin, trimethylolpropane, pentaerythritol, sorbitol and sucrose; and polymers thereof such as polyethylene glycols, polypropylene glycols and polyglycerins; and polyhydric phenols such as hydroquinone, catechol, phloroglucin and bisphenols such as bisphenol A;

3) amino or amide group-containing compounds including ammonia; saturated or unsaturated, primary and/or secondary (poly)amines generally containing 1–30 carbon atoms, for example, (cyclo)aliphatic amines such as mono- and dimethyl amines, ethyl amines, propyl amines, butyl amines, (cyclo)hexyl amines, octyl amines, stearyl amines, oleyl amines, myristyl amines and coconut amines; and polyamines such as ethylenediamine and tetraethylenepentamine; saturated or unsaturated, primary and/or secondary amides, generally containing 1–30 carbon atoms, for example, aliphatic amides such as acetoamide, propionamide, octylamide, stearyl amides, oleyl amides, myristyl amides and monomethylpropionamide; active hydrogen atom-containing heterocyclic compounds such as morpholine, piperazine and aminoethylpiperazine.

Among the active hydrogen atom-containing compounds, those containing hydroxyl, amino and/or amide group(s) only as the active hydrogen atom-containing group(s) are preferred to carboxyl-containing compounds such as hydroxy acids, which include citric and gluconic acids, which form ester linkages upon reaction with alkylene oxides and cause an increase in solubility of the (meth)acrylate in the resulting surfactants.

Suitable alkylene oxides, which are used for reaction with active hydrogen-atom containing compounds, include those containing 2 to 4 carbon atoms such as ethylene oxide, propylene oxide, 1,2-, 2,3-, 1,3- and 1,4-butylene oxides, and combinations of two or more thereof (random- or block- addition). Preferred alkylene oxides are ethylene oxide, propylene oxide and combinations thereof.

The amount of alkylene oxides employed usually ranges from 1 to 50 moles, preferably 1 to 35 moles per mole of the active hydrogen atom-containing compound employed. The amount of the alkylene oxide employed varies depending on the type of active hydrogen atom-containing compound, alkylene oxide, olefinic copolymer and poly(meth)acrylate employed, as well as on the molecular weights of these polymers. The function of the alkylene adducts as poor solvents for both components (A) and (C) can be increased with an increase in the amount of alkylene oxides, but a lower amount of alkylene oxide is preferred from the viewpoint of surface activity.

Suitable alkylene oxide adducts are those preferably represented by the formula:

$$R—O—(AO)_nH$$

where R is H, an alkyl group containing at most 8 carbon atoms and a cycloalkyl group; n is an integer of 1 to 35; and A is an alkylene group containing 2 to 3 carbon atoms. Particularly preferred are those of formula (I), wherein R is alkyl.

It is essential in this invention that component (D) function as a poor solvent for both components (A) and (C). In general, the solubility of (A) in (D) is 30% by weight or less and that of (C) in (D) is 30% by weight or less, at 20° C. In other words, (D) is capable of dissolving only 30% by weight or less of (B) while being capable of dissolving only 30% by weight or less of (A). The upper limit of the solubility means the highest concentration which can provide, by dissolving each polymer either (A) and (C) alone in (D), a solution of transparent homogeneous appearance without forming a turbid solution or resulting in phase-separation. For instance, the solubility of (C) in (D) being less than 5% by weight means that the solution becomes turbid or phase-separation occurs when 5% by weight of (C) and 95% by weight of (D) are blended at 20° C. The preferred solubility of (A) in (D) is 15% or less, particularly 5% or less, and that of (C) in (D) is 15% or less, particularly 5% or less.

Illustrative examples of component (D) are as follows:

$C_4H_9—O—(C_3H_6O)_4H$ Surfactant D1

$C_4H_9—O—(C_2H_4O)_5H$ Surfactant D2

$C_4H_9—O—(C_2H_4O)_2(C_3H_6O)_{1.5}H$ Surfactant D3

$C_8H_{17}—O—(C_2H_4O)_{10}H$ Surfactant D4

$C_4H_9—O—(C_2H_4O)_5(C_3H_6O)_{10}H$ Surfactant D5

$CH_3—O—(C_2H_4))_3H$ Surfactant D6

$HO—(C_3H_6O)_{30}H$ Surfactant D7

$C_4H—N(CH_3)—(C_2H_4O)_5(C_3H_6O)_5H$ Surfactant D8

$C_4H_9—N(—(C_2H_4O)_5(C_3H_6O)_5H)—(C_2H_4O)_5(C_3H_6O)_5H$ Surfactant D9

$C_3H_7—CO—N(—(C_2H_4O)_4H)—(C_2H_4O)_4H$ Surfactant D10

$C_4H_9—O—(C_2H_4O)_2(C_3H_6O)_{1.5}H$ + $C_4H_9—O—(C_3H_6O)_5H$ (weight ratio: 1:1) Surfactant D11

COMPOSITIONS

In polymer compositions comprising components (A), (B), (C) and (D) of the present invention, the total polymer content, i.e., the total amount of (A), (B) and (C), is generally 30–60%, preferably 35–50%, based on the weight of the composition.

The content of component (B) is at least 5%, preferably 10% –40%, based on the total weight of the polymer [(A)+(B)+(C)]. The content of the component (A) is preferably 10%–60%, more preferably 20%–50%; and the content of the component (C) is preferably 25%–80%, more preferably 30%–60%, based on the total weight of the polymer.

In the present invention, component (A) includes olefinic copolymers (hereinafter referred to as OCP), and OCP onto which is grafted a small amount of (meth)acrylate, the result of which is that the graft copolymer has substantially the same solubility characteristics as OCP. Similarly, component (C) includes poly(meth)acrylates, and OCP onto which is grated a larger excess of (meth)acrylate with the resulting graft copolymer having substantially the same solubility characteristics as poly(meth)acrylates.

The total olefinic copolymer content, i.e., the content of (A) + the olefinic copolymer portion of (B), in the composition is generally 10–95%, preferably 20–90%, more preferably 20–70%, most preferably 30–60%, and the total poly(meth)acrylate content, i.e., the content of (C) + the poly(meth)acrylate portion of (B), in the composition is usually 90–5%, preferably 70–40%, based on the total weight of the components (A), (B) and (C).

The content of component (D) is usually 2–70%, preferably 2–35%, more preferably 5–20%, based on the weight of the composition.

Polymer compositions according to the invention may further contain a mineral oil as component (E). Suitable mineral oils include those usually used as base oils for engine oils, for example, 60 neutral, 100 neutral, 150 neutral and 500 neutral oils, and mixtures of two or more of the oils.

The total content of (D) and (E) in the composition is generally 40–70%, preferably 50–65%, based on the weight of the composition.

The weight ratio of (E)/(D) generally ranges from 0/100–95/5, preferably 50/50–95/5, more preferably 70/30–90/10.

In producing polymer compositions comprising components (A), (B), (C) and (D) according to the present invention, (D) may be added with stirring to polymerized products at any temperature between room temperature and the polymerization temperature, usually 80–130° C., the products having been prepared by polymerizing (meth)acrylates, and optionally other monomers, in situ in (A) dissolved in (E). A portion usually 50% or less, of (D) may be added to (E) before polymerization, followed by conducting polymerization and then adding the remainder of (D). Mixing may be performed using stirrers which impart a high mechanical shear to material such as a homomixer.

The polymer compositions of the invention, useful as a VI improver, may contain other components, if desired. Suitable examples of such components are: detergent-dispersants such as perbasic alkaline earth metal salts of sulfonates or phenates, alkenylsuccinimides, Mannich condensates of alkylphenols, polyamines and formaldehydes, and the like; antioxidants such as zinc thiophosphate, zinc thiocarbamate, hindered phenols and amines, and the like; a friction modifier such as dithiophosphate molybdenum complex; extreme pressure additives such as sulfur compounds and phosphorus compounds, and so on.

It is essential in the present invention, that the surfactant (D) be a poor solvent for both (A) and (C). This is a basic difference from ester type solvents, known as carriers or vehicles, which are a good solvent for (C). The solubility of (A) or (C) in (D) or in conventional vehicles is shown in Table 1.

TABLE 1

| | SOLUBILITY (20° C.) | | | | | |
|---|---|---|---|---|---|---|
| | 5% | | 15% | | 30% | |
| | OCP | PMA | OCP | PMA | OCP | PMA |
| Surfactant D2 | PS | PS | PS | PS | PS | PS |
| Surfactant D3 | PS | PS | PS | PS | PS | PS |
| Surfactant D4 | PS | PS | PS | PS | PS | PS |
| Surfactant D11 | PS | PS | PS | PS | PS | PS |
| Mineral oil | HT | HT | HT | HT | HT | HT |
| Dibutyl phthalate | PS | HT | PS | HT | PS | HT |
| Dioctyl adipate | PS | HT | PS | HT | PS | HT |
| Tributyl phosphate | PS | HT | PS | HT | PS | HT |

(Notes)
PS: phase-separation occurred.
HT: homogeneous transparent solution formed.
OCP: the same olefinic copolymer as used in Example 1.
PMA: a polymethylacrylate (Mw 74,000) prepared separately from the same monomer composition as in Example 1.

As is apparent from Table 1, the surfactants (D) [D2, D3, D4 and D11] of the present invention show poor solubility of less than 5% by weight for both OCP (A) and PMA (C), while ester type known vehicles show good solubility of more than 30% by weight for PMA (C).

In addition, known vehicles are substantially less good solvents for the olefinic copolymers by virtue of the (meth)acrylate esters, as described in U.S. Pat. No. 4,290,925; whereas the surfactants (D) of the present invention are already poor solvents for (A) even in the absence of (C). This is shown in Table 2 below.

The solubility of (A) or/and (C) in various vehicles and (E) are shown in Table 2. The solubility characteristics were measured at the same ratio as in a typical composition of this invention, containing 12 parts of (D) and 48 parts (E) and having the total OCP content of 16% and the total PMA content of 24%, based on the weight of the composition. In the case where used in combination with mineral oil, known ester type vehicles such as dibutyl phthalate, dioctyl adipate and tributyl phosphate are good solvents for not only PMA, but also OCP. When 16% of OCP, 24% of PMA, 12% of such ester type vehicle and 48% of mineral oil were blended, the OCP component was gelled and separated into an upper phase. This means that vehicles comprising known ester type vehicles and mineral oil are substantially less good solvents for OCP by virtue of PMA, as described in U.S. Pat. No. 4,290,925. The OCP to be separated is emulsified or phase-stabilized without being separated, by the presence of graft-copolymer as an emulsifier, according to U.S. Pat. No. 4,290,925. On the other hand, surfactants (D) in the present invention are poor solvents for OCP without virtue of PMA. Thus, surfactants (D) in the invention shows quite different solubility behavior for PMA and OCP, from known vehicles.

TABLE 2

| | | Solubility (20° C.) | |
|---|---|---|---|
| Composition | OCP (A), parts | — | 16 |
| | PMA (C), parts | 24 | — |
| | Vehicle, parts | 12 | 12 |
| | Mineral oil, parts | 48 | 48 |
| Kind of vehicle | Surfactant D2 | PSG-TD | PSG |
| | Surfactant D3 | TD | PSG |
| | Surfactant D4 | PSG-TD | PSG |
| | Surfactant D11 | TD | PSG |
| | Mineral oil | HT | HT |
| | Dibutyl phthalate | HT | HT |
| | Dioctyl adipate | HT | HT |
| | Tributyl phosphate | HT | HT |

(Notes):
PSG: phase-separation occurred or the total phase gelled.
TD: turbid dispersion was formed.
HT: homogeneous transparent solution was formed.
OCP and PMA: the same as in Table 1.

The surfactant (D) of the invention acts as a solubilizer or phase-stabilizer for components (A) and (C) in combination with component (B), which has good surface activity properties, as a phase-stabilizer, whereby solubilized or stabilized polymer compositions can be obtained. Polymer compositions, produced using (D) in conjunction with (B), are of much lower viscosity in comparison to those of the prior art and of uniform transparent or slightly transparent appearance. Components (A) and (C) are stably solubilized in the composition. There can be obtained polymer compositions substantially free from any polymer particles. Even when polymer particles are present in these compositions, such particles are present in only very small amounts and are of smaller diameter such as less than 0.1 microns, than those in the prior art such as 2–60 microns.

Accordingly, the polymer compositions of the present invention are useful as VI improvers for lubricating oils. Examples of suitable base oils for lubricating oils include mineral oils, such as those usually used as base oils for engine oils, for example, 60 neutral, 100 neutral, 150 neutral and 500 neutral oils, and mixtures of two or more of these oils.

The polymer compositions of the present invention may be used in a given formulation in a minor portion, which is sufficient to improve the viscosity index of the formulation. For instance, the present composition can be used in an amount of from 0.3%–10%, preferably 0.5%–5%, in a lubricating oil composition.

Having generally described the invention, a more complete understanding can be obtained by reference to certain specific examples, which are included for purposes of illustration only and not intended to be limiting unless otherwise specified.

In the following examples, parts, ratio and % mean parts by weight, weight ratio and % by weight, respectively.

EXAMPLES 1–11 AND COMPARATIVE EXAMPLES 1–5

Into a pressure reaction vessel were charged 40 parts of a mineral oil (100 neutral oil), 30 parts of a ethylene-propylene copolymer [ethylene/propylene=50/50, Mw=80,000], 28 parts of $C_{14-15}$ alkyl methacrylate, 12 parts of $C_{16-18}$ alkyl methacrylate, 4 parts of methyl methacrylate and 2 parts of N-vinylpyrrolidone, and the mixture was stirred under an atmosphere of nitrogen at 120–150° C. under pressure. The ingredients dissolved to form a homogeneous solution. After dissolution of the components, a mixed solution of 0.9 parts of di-t-butyl diperoxyisophthalate, 0.4 parts of 1,1-bis(t-peroxy)3,3,5-trimethylcyclohexane and 36 parts of a mineral oil was added to the solution at 110–115° C. at a uniform rate over a period of an hour, followed by maintaining the temperature for an additional 3 hours to complete the polymerization. A very viscous composition having a 48% polymer content was obtained. The olefinic copolymer/polymethacrylate ratio was 40/60, and the Mw of polymethacrylate was 74,000, measured by GPC using a polystyrene calibration curve.

To 100 parts of this product, were added 6 parts of a mineral oil and 14 parts of each surfactant or vehicle shown in Table 3. The ingredients were mixed at room temperature to obtain polymer compositions of 40% polymer content. The viscosity of each composition obtained was measured as well as its storage stability. The results are shown in Table 3.

TABLE 3

| | | Surfactant or Vehicle | Viscosity, cps at 40° C. | Appearance | Storage stability |
|---|---|---|---|---|---|
| Example | 1 | Surfactant D1 | 9,200 | TLS | Stable |
| | 2 | Surfactant D2 | 7,600 | TLS | Stable |
| | 3 | Surfactant D3 | 7,000 | TLS | Stable |
| | 4 | Surfactant D4 | 6,800 | TLS | Stable |
| | 5 | Surfactant D5 | 8,300 | TLS | Stable |
| | 6 | Surfactant D6 | 7,400 | TLS | Stable |
| | 7 | Surfactant D7 | 10,600 | TLS | Stable |
| | 8 | Surfactant D8 | 10,200 | TLS | Stable |
| | 9 | Surfactant D9 | 10,500 | TLS | Stable |
| | 10 | Surfactant D10 | 10,400 | TLS | Stable |
| | 11 | Surfactant D11 | 8,100 | TLS | Stable |
| Comparative Example | 1 | Mineral oil | >100,000 | GEL | PS/1M |
| | 2 | Dibutyl phthalate | 14,500 | TD | Stable |
| | 3 | Dioctyl adipate | 15,400 | TD | Stable |
| | 4 | Tributyl phosphate | 14,800 | GEL | Stable |
| | 5 | DEG dipropionate | 12,200 | TD | PS/1M |

(Notes)
DEG: diethylene glycol
TLS: very slightly translucent solution
GEL: gel-like heterogeneous mixture
TD: turbid dispersion
PS/1M: phase-separation occurred after one month.

The diameters of particles present in some of these compositions were also observed with a phase contrast microscope. The results are as follows:

| | Particle diameter, microns |
|---|---|
| Example 1 | <0.1 |
| Example 2 | <0.1 |
| Example 11 | <0.1 |
| Comparative Example 2 | 2–40 |

EXAMPLES 12–14 and COMPARATIVE EXAMPLES 6–8

In the same manner as described in Examples 1–11, 30 parts of the same ethylene-propylene copolymer described above, 31 parts of a $C_{14-15}$ alkyl methacrylate, 3 parts of a $C_{16-18}$ alkyl methacrylate, 10 parts of methyl methacrylate and 2 parts of N-vinylpyrrolidone were polymerized. A very viscous composition of 48% polymer content was obtained. The molecular weight of the polymethacrylate was 89,000.

To 100 parts of this product were added 6 parts of a mineral oil and 14 parts of each surfactant or vehicle shown in Table 4. The ingredients were mixed at room temperature to obtain polymer compositions of 40% polymer content. The viscosity of each product was measured. The results are shown in Table 4.

TABLE 4

| | | Surfactant or Vehicle | Viscosity, cps at 40° C. | Appearance | Particle diameter microns |
|---|---|---|---|---|---|
| Example | 12 | Surfactant D1 | 7,600 | TP | NP |
| | 13 | Surfactant D3 | 8,200 | TP | NP |
| | 14 | Surfactant D11 | 7,300 | TP | NP |
| Comparative Example | 6 | Dibutyl phthalate | 13,300 | TD | 2–30 |
| | 7 | Dioctyl adipate | 14,900 | TD | 2–25 |
| | 8 | Tributyl phosphate | 20,600 | GEL | 15–50 |

(Notes)
TP: uniform transparent solution
GEL: gel-like heterogeneous mixture
TD: turbid dispersion
NP: No particles were observed.

As shown in Table 4, the polymer compositions obtained by using component (D) of the present invention were perfectly solubilized and showed no thixotropic properties. Further, no particles were observed with a phase contrast microscope. On the other hand, the polymer composition obtained by using known ester type vehicles were emulsions containing deposited OCP particles and which had higher viscosity and strong thioxotropic properties.

EXAMPLE 15–19

Each of the polymer compositions of Examples 1, 2, 11, 12 and 14 was added to a base oil (a 150 N) thereby preparing several lubricating oil formulations. The properties of the resulting oils obtained are shown in Table 5.

TABLE 5

| Example | | 10 | 16 | 17 | 18 | 19 |
|---|---|---|---|---|---|---|
| Example No. of Polymer Composition | | 1 | 2 | 11 | 12 | 14 |
| Dosage, % | VII | 4.0 | 4.0 | 4.0 | 4.0 | 4.0 |
| | Package* | 11.0 | 11.0 | 11.0 | 11.0 | 11.0 |
| Viscosity, cst. | 40° C. | 62.43 | 62.51 | 62.46 | 61.76 | 61.89 |
| | 100° C. | 10.10 | 10.09 | 10.08 | 10.01 | 10.00 |
| Viscosity index | | 148 | 148 | 148 | 148 | 147 |
| Pour point, C | | −42.5 | −42.5 | −42.5 | −42.5 | −42.5 |
| CCS Vis., cps. at −20° C. | | 2,400 | 2,400 | 2,350 | 2,510 | 2,380 |
| Sonic shear | 40° C. | 22.0 | 22.1 | 21.9 | 21.8 | 22.2 |

TABLE 5-continued

| Example | 10 | 16 | 17 | 18 | 19 |
|---|---|---|---|---|---|
| stability, % 100° C. | 19.3 | 19.1 | 19.5 | 19.6 | 19.3 |

(Note)
*:SF grade

Having now fully described the invention, it will be apparent to one of ordinary skill in the art that many changes and modifications can be made thereto without departing from the spirit or scope of the invention as set forth herein.

What is claimed as new and desired to be secured by Letters Patent is:

1. A polymer composition, useful as a lubricating oil additive to improve the viscosity index thereof, comprising:

(A) an olefinic copolymer;

(B) a copolymer of an olefin with an acrylate or methacrylate;

(C) a polyacrylate or polymethacrylate; and (D) an oxyalkylated active hydrogen atom-containing surfactant, which is a poor solvent for both components (A) and (C), which acts as a solubilizer or phase-stabilizer for components (A) and (C), and which in combination with component (B) which has surface active properties functions as a phase-stabilizer, wherein the total polymer content is 30%-30% based on the weight of the composition, the contents of (A) being 10%-60%, the content of (B) being at least 5% and the content of (C) being 25%-80%, based on the total weight of the total polymer, and the content of (D) is 2%-70% based on the weight of the composition.

2. The composition of claim 1, wherein component (D) is an alkylene oxide adduct of a compound containing at least one active hydrogen atom-containing group selected from the group consisting of hydroxyl, amino and amide groups.

3. The composition of claim 1, wherein component (D) is an alkylene oxide adduct of a hydroxyl-containing compound.

4. The composition of claim 1, wherein component (D) is a compound of the formula:

$$R—O—(AO)_n—H \quad (I)$$

wherein R is H, an alkyl group containing at most 8 carbon atoms or a cycloalkyl group; n is an integer of 1 to 35; and A is an alkylene group containing 2 or 3 carbon atoms.

5. The composition of claim 1, wherein the content of component (D) is 2-35% based on the weight of the composition.

6. The composition of claim 1, wherein the total olefinic copolymer content is 20-90% and the total polyacrylate or polymethacrylate content is 80-10%, based on the total weight of components (A), (B) and (C).

7. The composition of claim 1, wherein component (A) has a molecular weight of about 30,000 to about 200,000.

8. The composition of claim 1, wherein component (C) has a molecular weight of about 20,000 to about 500,000.

9. The composition of claim 1, wherein component (D) is capable of dissolving only 30% by weight or less of component (C).

10. The composition of claim 1, wherein component (D) is capable of dissolving only 15% by weight or less of component (C).

11. The composition of claim 1, wherein component (D) is capable of dissolving only 5% by weight or less of component (C).

12. The composition of claim 1, wherein component (D) is capable of dissolving only 5% by weight or less of component (A).

13. The composition of claim 1, which further contains (E) a mineral oil.

14. The composition of claim 1, wherein the total content of components (D) and (E) is 40-70% based on the weight of the composition.

15. The composition of claim 1, which has a substantially transparent or translucent appearance.

16. The composition of claim 1, which has a low viscosity of about 10,000 cps. or less, measured at a 40% polymer content at 40° C.

17. The composition of claim 1, wherein the polymethacrylate in component (B) and component (C) is comprised of monomer units as follows:

(a) at least 50% of C8-30 alkyl methacrylate units, (b) 0-50% of $C_{1-4}$ methacrylate units, and (c) 0-50% of other monomer units.

18. The composition of claim 19, wherein the monomer units contain at least 7% of C1-4 alkyl methacrylate units and 15% or less of C16-30 alkyl methacrylate units.

19. A lubricating oil having improved viscosity index, which comprises:

a major portion of mineral oil, and a minor portion, sufficient to improve the viscosity index, of a lubricating oil additive comprising:

(A) an olefinic copolymer;

(B) a copolymer of an olefin with an acrylate or methacrylate;

(C) a polyacrylate or polymethacrylate; and (D) an oxylated active hydrogen atom-containing surfactant, which is a poor solvent for both components (A) and (C), which acts as a solubilizer or phase-stabilizer for components (A) and (C), and which in combination with component (B), which has surface active properties, functions as a phase-stabilizer, wherein the total polymer content is 30%-60% based on the weight of the composition, the contents of (A) being 10% -60%, the content of (B) being at least 5% and the content of (C) being 25% -80%, based on the total weight of the total polymer, and the content of (D) is 2% -70% based on the weight of the composition.

20. The lubricating oil of claim 19, wherein the lubricating oil additive is present in an amount of 0.3%-10%.

* * * * *

UNITED STATES PATENT AND TRADEMARK OFFICE

CERTIFICATE OF CORRECTION

PATENT NO. : 5,026,496

DATED : June 25, 1991

INVENTOR(S) : SHOJI TAKIGAWA ET AL

It is certified that error appears in the above-identified patent and that said Letters Patent is hereby corrected as shown below:

Col. 11

Claim 1, line 29, delete "30%-30%" in favor of --30%-60%--.

Signed and Sealed this

Twentieth Day of April, 1993

*Attest:*

MICHAEL K. KIRK

*Attesting Officer*

*Acting Commissioner of Patents and Trademarks*